US005425426A

United States Patent [19]

Baratov et al.

[11] Patent Number: 5,425,426

[45] Date of Patent: Jun. 20, 1995

[54] FIRE EXTINGUISHING METHODS AND SYSTEMS

[75] Inventors: Anatoly Baratov; Iousef Myshak, both of Moscow, Russian Federation; Yechiel Spector; Ester Jacobson, both of Tel Aviv, Israel

[73] Assignee: Spectronix Ltd., Sderot, Israel

[21] Appl. No.: 120,496

[22] Filed: Sep. 14, 1993

Related U.S. Application Data

[62] Division of Ser. No. 921,651, Jul. 30, 1992, abandoned.

[30] Foreign Application Priority Data

Mar. 19, 1992 [IL] Israel ..... 101298
May 6, 1992 [IL] Israel ..... 101802

[51] Int. Cl.[6] ..... A62C 3/00
[52] U.S. Cl. ..... 169/46; 169/12
[58] Field of Search ..... 169/12, 14, 15, 44, 169/54, 68, 46, 84; 252/4, 5, 6

[56] References Cited

U.S. PATENT DOCUMENTS

| | | | |
|---|---|---|---|
| 82,582 | 9/1868 | Babcock | 252/5 |
| 191,306 | 5/1877 | Budy | 252/5 X |
| 278,315 | 5/1883 | Crikelair | 252/5 |
| 1,807,456 | 5/1931 | Wedger et al. | 252/5 |
| 2,074,938 | 3/1937 | Reed | 252/6 |
| 3,843,525 | 10/1974 | Hattori et al. | 252/5 X |
| 3,972,820 | 8/1976 | Filter et al. | 252/5 |
| 4,961,865 | 10/1990 | Pennartz | 169/46 X |
| 5,082,575 | 1/1992 | Yamaguchi | 169/44 X |

*Primary Examiner*—David M. Mitchell
*Assistant Examiner*—Gary C. Hoge
*Attorney, Agent, or Firm*—Mark M. Friedman

[57] ABSTRACT

Methods and related systems for extinguishing a fire in a volume which includes pre-positioning a fire extinguishing medium in or near the volume. The medium includes at least two reactants, typically an oxidant and a reducing agent which are activated manually or automatically in response to the fire causing the two reactants to react with each other and to form an aerosol capable of interacting with the propagation centers of the fire, interrupting the propagation of the fire, and thereby extinguishing it.

9 Claims, 3 Drawing Sheets

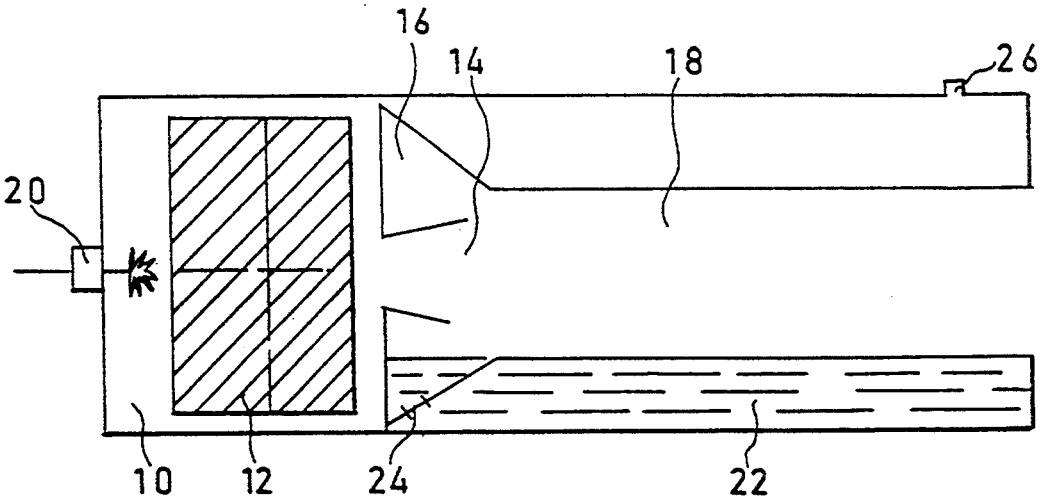
FIG.1
FIG.2
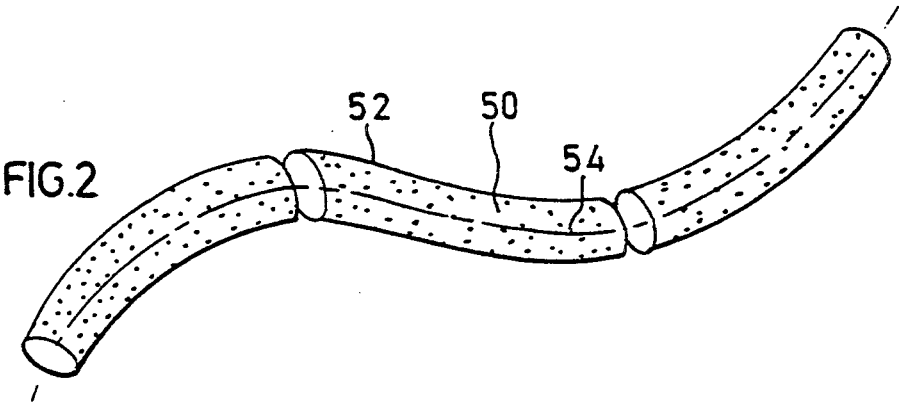
FIG.3
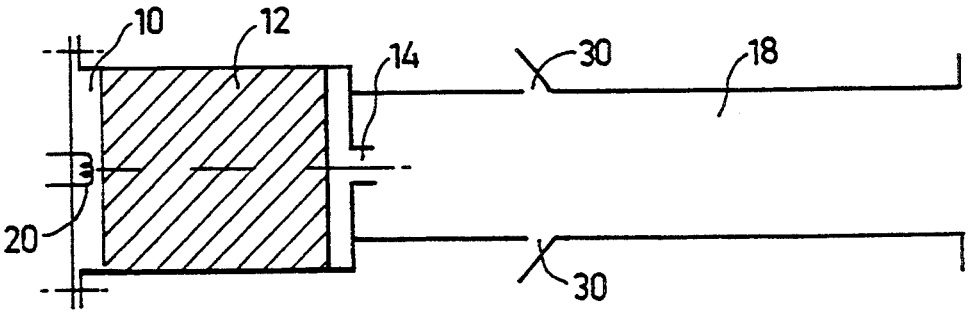

FIRE EXTINGUISHING METHODS AND SYSTEMS

This is a division of U.S. patent application Ser. No. 07/921,651, filed Jul. 30, 1992 now abandoned.

FIELD AND BACKGROUND OF THE INVENTION

The present invention relates to fire extinguishing methods and associated systems and, more particularly, to methods and related systems which do not involve halocarbons and which are highly effective in extinguishing fires, even when relatively small quantities of chemicals are used.

The present invention relates, in particular, to methods and systems for volume fire extinguishing. Volume fire extinguishing involves the temporary creation of an atmosphere which is incapable of sustaining combustion within the volume to be protected, typically a relatively confined volume.

One of the volume fire extinguishing methods in most widespread use at present includes the introduction of volatile halocarbons, such as Halon 1301, for example, into the volume to be protected. Halocarbons have excellent fire extinguishing capacity which is attributable to their being inhibitors of combustion. Halocarbons actively interfere with the chemical reactions taking place in the flame and effectively inhibit them.

Furthermore, halocarbons have a number of desirable properties such as low toxicity. In addition, halocarbons gases can be rather easily liquefied under pressure, making them easily storable in the liquefied state. Halocarbons do not adversely affect equipment and other materials with which they come in contact.

Nevertheless, halocarbons suffer from a fundamental disadvantage, namely, they are known to interact with ozone, which leads to the destruction of the earth's ozone layer. According to the 1987 Montreal Protocol, which prescribed a number of international measures for the protection of the earth's ozone layer, the use of halocarbons is to be completely banned by the year 2000.

It is thus quite urgent to find alternative volume fire extinguishing means which could successfully act as a replacement for halocarbons. A successful replacement for halocarbons would possess a volume fire extinguishing effectiveness at least equal to that of halocarbons, yet would be ecologically safe.

Two basic types of such ecologically benign fire extinguishing materials are presently known. The first includes inert gaseous diluents, such as carbon dioxide, nitrogen water vapor, and the like. The second type includes fire extinguishing powders based on mineral salts, such as carbonates, bicarbonates, alkali metal chlorides, ammonium phosphates, and the like.

As presently implemented, both types of materials suffer from serious disadvantages. Inert gaseous diluents are largely ineffective in disrupting the reactions taking place in the flame. Rather, inert diluents act by diluting the air in the volume being protected, thereby lowering the oxygen concentration below that required to sustain the combustion. An example of the use of inert diluents is disclosed in U.S. Pat. No. 4,601,344 to Reed which relates to a gas generating composition containing glycidyl azide polymer and a high nitrogen content additive generates large quantities of nitrogen gas upon burning and can be used to extinguish fires.

For relatively airtight volumes, the amount of diluent required roughly equals the amount of air already in the volume prior to combustion. If the volume to be protected is not airtight, the required volume of the inert diluent must be several times that of the protected volume.

Fire extinguishing methods based on inert dilution require relatively large amounts of diluent and are appreciably less effective and reliable than extinguishing with halocarbons.

Volume fire extinguishing with the help of powders is carried out by dispensing a powder aerosol in the volume to be protected. The aerosol envelops the flame thereby suppressing it. It is believed that powders chemically interrupt combustion by forcing the recombination and deactivation of chain propagators responsible for sustaining the combustion process in the focus of fire.

Such recombination is believed to occur both at the surface of the solid particles of the aerosol and, to some extent, also in reactions of the chain propagators with gaseous products of the evaporation and decomposition of powders in the flame. Chain propagators are gaseous atomic particles or radicals having a free valence, which serve to initiate and sustain the branched chain reactions characteristic of combustion processes in combustible substances containing carbon.

However, the efficiency of presently implemented volume fire extinguishing with the help of powders is also of limited efficacy because of the comparatively low dispersity of the fire-extinguishing powders. The particle size of presently used powders ranges from about 20 to about 60 microns. Such large particles have a relatively low surface to volume ratio. Since the desired reactions take place largely on the surface of the particles, a given amount of such powders has a limited capacity for interrupting the chain reactions and putting out the fire.

Further, it is difficult to prepare an aerosol of such powders which will distribute uniformly throughout the volume to be protected. It is, in addition, difficult to ensure that the powder particles, once formed, will stay in their original suspended state while stored for a sufficiently long period prior to use so as to maintain the viability of the product as a fire extinguishing composition. Finely-dispersed powders have a strong tendency to agglomerate, or cake, during storage. Such agglomeration greatly hinders the dispensing of the material from its storage container during use. Furthermore, whatever particles are able to leave the storage container and come in contact with the fire, are relatively coarse-grained powder particles, having a relatively low surface area to volume ratio and thus possessing reduced fire extinguishing capacity per unit weight.

Attempts have been made to solve the problems associated with the long-term storage of finely divided powders. Exemplary of such attempts is U.S. Pat. No. 4,234,432 to Tarpley, which discloses a powder dissemination composition in which the powder is contained in a thixotropic gel which prevents the agglomeration, sintering and packing of the powder material. The finely divided powder has at least a bimodal particle distribution size distribution encapsulated in a gelled liquid. The method appears to be complex, requiring the fabrication of a powder of well-defined particle size distribution.

In at least one case, attempts have been made to get around the storage problems by creating storing reaction precursors rather than the actual powders. U.S. Statutory Invention No. H349 to Krevitz et al. discloses reagent compositions which are chemically inert when solid and are chemically active when molten. The reagent compositions may comprise a first substance such as a high molecular weight wax or polymer and a second substance which is dissolved, dispersed, or encapsulated in a solid matrix of the first substance. The second substance is a highly chemically reactive compound such as a strong base or a strong acid. As solids, the reagent compositions are inert. When molten, the second substance is exposed and the resultant liquid solutions are highly reactive.

There is thus a widely recognized need for fire extinguishing methods and systems which are at least as effective as those involving the use of halocarbons but which are ecologically safe.

Specifically, there is a clear need for, and it would be highly advantageous and desirable to have, fire extinguishing methods and systems which use chemicals which do not adversely affect the earth's ozone layer and which are capable of putting out fires quickly and efficiently.

SUMMARY OF THE INVENTION

According to the present invention there is provided a method of extinguishing a fire in a volume, comprising: (a) pre-positioning a fire extinguishing medium in communication with the volume, the medium including a composition which includes: (1) a first reactant which includes one or both of potassium perchlorate and potassium nitrate; and (2) a second reactant which includes epoxy resin; (b) activating the medium in situ so as to cause the first reactant and the second reactant to react with each other to create a non-toxic aerosol of dry powder having solid particulate products having a diameter of about one micron or less, the aerosol being such that when the aerosol comes in contact with the fire, the products chemically and physically inhibit the chain reactions of the fire flame and bring about the extinguishing of the fire; (c) cooling the aerosol through contact of the aerosol with a cooling medium; and (d) arresting flames which may accompany the aerosol.

According to the present invention there is also provided a system for extinguishing a fire in a volume, comprising: a fire extinguishing medium pre-positioned in communication with the volume, where the medium includes a composition which includes: (1) a first reactant; and (2) a second reactant; where the medium is activated so as to cause the first reactant and the second reactant to react with each other to create solid particulate products having a diameter of about one micron or less such that, when the products come in contact with the fire, the products chemically inhibit the chain reactions of the fire and bring about the extinguishing of the fire.

According to further features in preferred embodiments of the invention described below, one of the reactants is an oxidant while the other reactant is a reducing agent.

According to still further features in the described preferred embodiments the composition may also contain a filler, such as potassium chloride or ammonium phosphate, and/or magnesium or aluminum.

According to another embodiment the gases which form during the reaction of the two reactants are cooled prior to their release, which cooling can be achieved by ejecting coolant into the aerosol, by intermixing the reaction products of a powdered composition with a coolant or by forcing the gases to pass through a coolant.

The present invention successfully addresses the shortcomings of the presently known configurations by providing ecologically benign methods and associated systems for putting out fires which is highly effective and which requires relatively small amounts of chemicals per unit volume protected.

The methods according to the present invention are advantageous in that they facilitate the rapid and reliable liquidation of the focus of fire anywhere in the protected volume. The methods can easily be automated, so as to be activated automatically upon the sensing, for example, of a certain preset elevated temperature in the volume, or other parameters which may indicate the presence of a fire, such as radiation, gaseous products, change in pressure, and the like.

The compositions involved in methods according to the present invention act to extinguish the target in at least two basic ways. One way, which is common to presently known powder fire extinguishes, involves the absorption of heat by, and consequent heating of, the solid particles, amplified by the evaporation of various chemical species. A second, and much more significant way of extinguishing the fire, is through the chemical interaction of various species present during the activation of species present during the activation of a composition according to the present invention with the flame chain reactions, effecting the interruption of these chain reactions.

The present invention is suitable in the fire protection of various volumes, including, but not limited to, various compartments, machine rooms, cable tunnels, cellars, chemical shops, painting chambers, reservoirs, storage vessels for oil products and liquefied gases, pump rooms handling combustible substances, and the like, as well as diverse means of transportation, such as motor vehicles, aircraft, ships, locomotives, armored vehicles, naval vessels, and the like.

BRIEF DESCRIPTION OF THE DRAWINGS

The invention is herein described, by way of example only, with reference to the accompanying drawings, wherein:

FIG. 1 is a cross sectional view of a cartridge according to the present invention which includes the use of water for cooling the associated gases;

FIG. 2 is an alternative embodiment showing a configuration wherein powder is positioned for fast burning and the simultaneous emission of aerosol;

FIG. 3 is another alternative configuration including air cooling of the formed gases;

Figure 5:
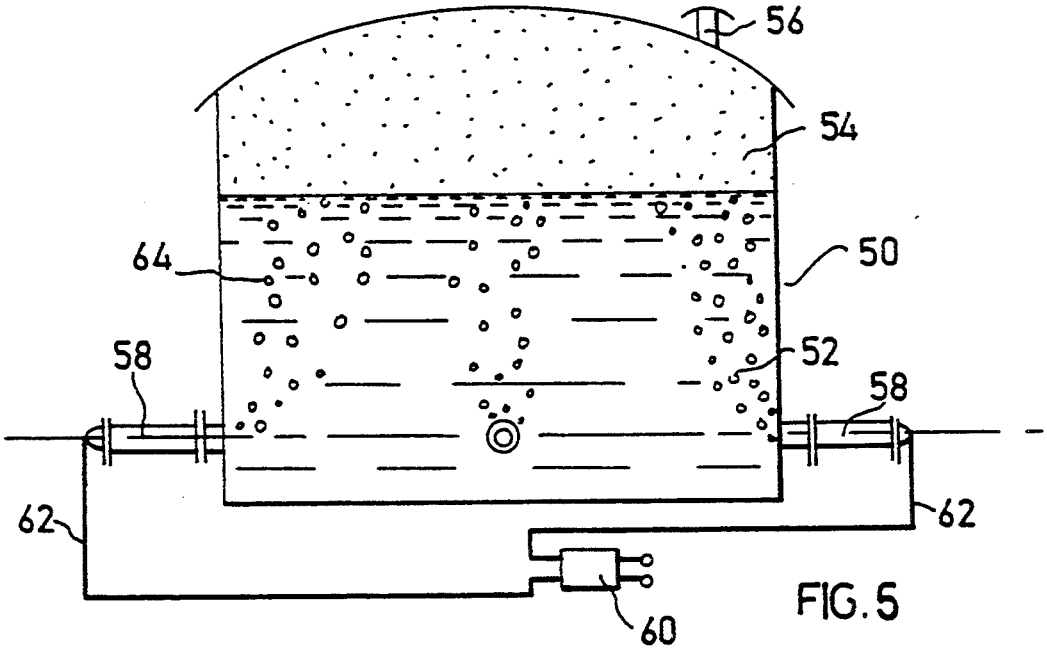
FIG. 5 is a side cross-sectional view of yet another alternative configuration involving the introduction of aerosol into the volume to be protected through a layer of liquid using a generator without integral cooling, using the liquid to cool the aerosol.

FIG. **6*a* is a side cross-sectional view of an alternative embodiment similar to that of FIG. 5** but where the powder is stored in destructible casings immersed in the liquid.

Figure 6A:
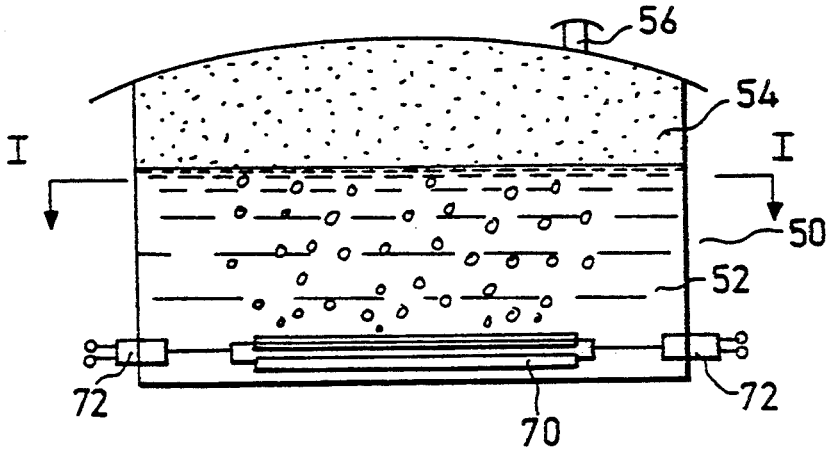

FIG. **6*b* is a top view of the embodiment of FIG. 6*a* along the section line I—I of FIG. 6*a***.

Figure 7A:
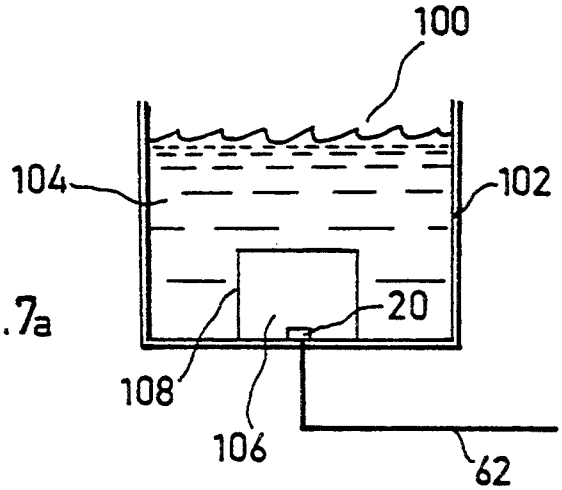

FIG. 7a is a side cross-sectional view of still another alternative configuration involving the introduction of aerosol into the volume to be protected through a layer of specially provided liquid using a generator without integral cooling, using the liquid to cool the aerosol.

Figure 7B:
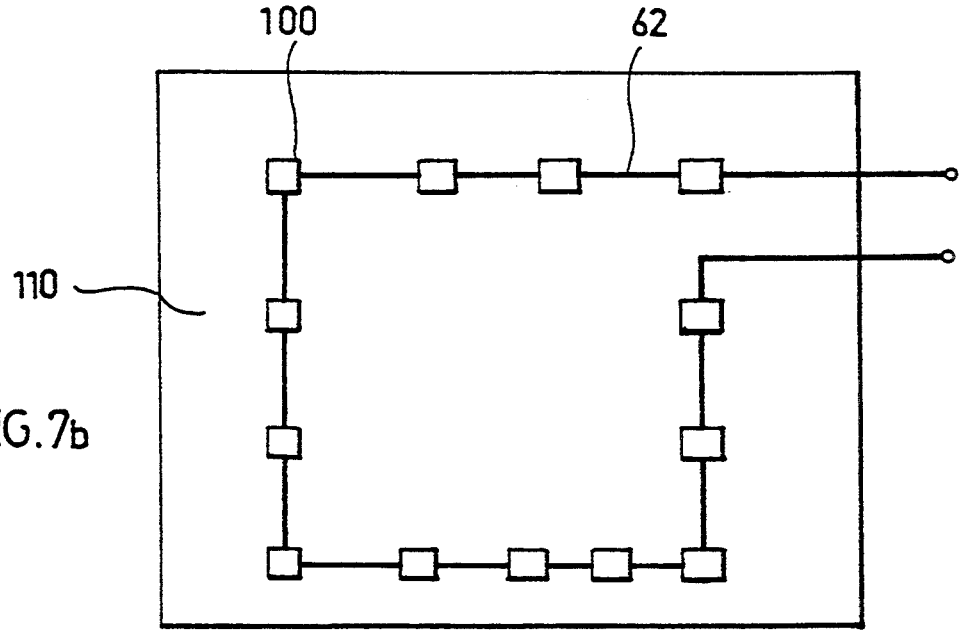

FIG. 7b is a schematic top view depiction of a possible system made up of several of the units of FIG. 7a connected to each other.

DESCRIPTION OF THE PREFERRED EMBODIMENTS

The present invention is of methods and associated systems which can be used to effectively extinguish fires and which are not harmful to the ozone layer.

Specifically, the present invention relates to storing two or more reactants which can be activated, directly or indirectly, and made to react upon the incidence of fire, forming products which tend to interfere with the propagation of the fire, thus serving to put out the fire.

A novel method for volume fire extinguishing is herein disclosed. A key feature of the present invention involves the in-situ formation of a very finely dispersed aerosol. The aerosol is not prepared ahead of time and stored, as in presently known systems. Rather, the aerosol is created or produced in situ during the fire accident, by combusting a solid-fuel composition or medium (hereinafter referred to as "SFC"), which includes at least two reactants capable of reacting with one another.

Preferably, one of the reactants is an oxidant while the other is a reducing agent. More preferably, the SFC further includes a filler, such as potassium chloride or ammonium phosphate. Upon reaction, the SFC forms gaseous products and solid aerosol particles in the combustion products. The gaseous products, and especially the solid aerosol particles, exert a strong inhibiting effect on the flame of the fire which is to be extinguished by promoting the recombination of combustion propagation centers, thereby inhibiting the continuation of the fire and extinguishing it.

In contrast with currently known powder volume fire extinguishing technologies, the systems according to the present invention obviate the need for storing an aerosol, usually stored as a powder and a separate pressurized propellant, such as air. As was described above, such storage leads to the gradual agglomeration of the particles, leading to dispensing difficulties and to reduced effectiveness brought about by the reduction of the particle surface areas.

The fire extinguishing capacity of an aerosol created in accordance with the present invention is greatly increased in comparison with known technologies since an aerosol according to the present invention is made up of particles of a much smaller size, typically on the order of one micron, and hence much larger surface to volume ratio, than has been heretofore known. The smaller particle size makes for a more highly dispersed and more highly effective aerosol.

As the particle size decreases, the extinguishing surface of the aerosol, on which heterogeneous recombination of the chain propagators takes place, increases. All other things being equal, the number of the aerosol particles per unit volume increases in inverse proportion to the cube of the diameter of the particles, whereas the surface area of the particles is directly proportional to the square of the diameter. Consequently, the total surface of the particles increases in inverse proportion to the diameter of the particles or in direct proportion to the dispersity of the aerosol.

Moreover, as the size of the particles diminishes, the rate of sublimation increases, and the extinguishing effect is augmented by homogeneous gas phase inhibition of the fire flame through the agency of gaseous products forming from the condensed part of the aerosol.

Without in any way restricting the scope of the present invention, it is believed that the contribution of the heterogeneous inhibition, involving reactions at the surface of the solid particles is generally more important than the homogeneous gas phase inhibition.

The ability of the aerosol to effect the recombination of the chain propagators depends to some extent on the chemical composition of the solid particles. It has been determined that the best fire propagation inhibiting properties are displayed by carbonates, bicarbonates, chlorides, sulfates, and oxides of metals such as, but not limited to, those belonging to Group IA of the Periodic Table, with the exception of Li and Fr. This is discussed, for example, on page 13 of in A. N. Baratov and L. P. Vogman, "Fire Extinguishing Powder Compositions", Moscow, Strojizdat Publishers, 1982, which article is incorporated herein in its entirety by reference as if fully set forth herein.

It has been further determined that the strongest inhibitors are strontium sulfates and cesium sulfates, with potassium chlorides and sodium chlorides being not quite as effective, and with potassium bicarbonates and sodium bicarbonates being somewhat less effective.

Taking into account the availability and cost, as well as the performance characteristics of these various inhibitors, it would appear that alkali metal chlorides may be commercially most suitable for use in fire extinguishing powders and aerosols.

According to the present invention these powders are created in situ in a finely dispersed form through the reactions of the SFC and are applied to the fire immediately following their creation. The SFC is combusted to produce the desired aerosol containing the compounds described above. Prior to combustion, the SFC includes at least two reactants which are capable of reacting with each other to form desired products.

Preferably, the SFC includes one reactant which is preferably an oxidant, such as potassium perchlorate, potassium dichromate, potassium nitrate, potassium chlorate, cesium nitrate or the like. The SFC further includes a second reactant preferably capable of acting as a reducing agent which may be one or more of various organic materials, such as rubber, polymeric materials, epoxy resin, phenol formaldehyde resin, and the like, or which may be phosphorus, sulfur, and the like. The SFC may also include a filler such as, but not limited to, potassium chloride. The filler serves the function of regulating the temperature of the aerosol by absorbing some of the heat of the oxidation-reduction reactions. Simultaneously, the filler serves as a source of potassium compounds which are used in extinguishing the fire.

It should be borne in mind that for extinguishing smoldering materials (fire accidents of Class A), it is necessary not only to liquidate flame burning in the gaseous phase but also to isolate the surface of burning material from air. This can be accomplished, for example, with the further inclusion in the SFC of ammonium phosphates, which are known fire extinguishing compounds.

The precise composition and concentration of a system according to the present invention is selected with an eye toward the type of fire likely to be encountered and the cost, availability and ease of use of the various suitable components. The possible combinations of components making up the SFC and their precise concentrations are virtually limitless. What is critical to methods and systems according to the present invention is not the precise composition but the in situ reaction, preferably an oxidation-reduction reaction, of two or more components of the SFC to form an aerosol having very fine solid particles.

As illustrations of typical SFC compositions, and without in any way limiting the scope of the present invention, nine possible compositions are described below.

| | |
|---|---|
| Composition 1: | |
| Potassium perchlorate | 40–50 wt % |
| Epoxy resin 7D-20 (with hardener) | 9–12 wt % |
| Potassium chloride | 40–44 wt % |
| Magnesium powder | 0–4 wt % |
| Composition 2: | |
| Potassium dichromate | 20 wt % |
| Gunpowder grade "H" | 80 wt % |
| Composition 3: | |
| Mg | 25 wt % |
| CsN03 | 75 wt % |
| Composition 4: | |
| Mg | 25 wt % |
| KN03 | 75 wt % |
| Composition 5: | |
| Iditol (phenol-formaldehyde resin) | 30 wt % |
| KN03 | 70 wt % |
| Composition 6: | |
| Potassium chlorate | 65–70 wt % |
| Potassium chloride | 16–20 wt % |
| Epoxy resin | 12–18 wt % |
| Composition 7: | |
| Potassium chlorate | 37–45 wt % |
| Potassium nitrate | 37–45 wt % |
| Epoxy resin | 16–19 wt % |
| Mg (or Al) | 1–3 wt % |
| Composition 8: | |
| Potassium nitrate | 70–80 wt % |
| Epoxy resin | 19–23 wt % |
| Mg (or Al) | 2–4 wt % |
| Composition 9: | |
| Cesium nitrate | 80–90 wt % |
| Epoxy resin | 10–20 wt % |

When selecting solid-fuel composition components, one should also ensure that both the initial composition of the SFC and its combustion products are non-toxic and explosion-proof. The explosion-proof compositions listed above were tested and were found to be characterized in that their combustion, while rapid, is incapable of becoming so rapid as to be become explosive. For illustrative purposes, it is believed that use of a combination of potassium perchlorate or potassium bichromate as the oxidant, rubber as a reducing agent, magnesium for enhancing the temperature and the rate of burning, and potassium chloride as filler provides an SFC which, upon combustion, produces an aerosol having a high inhibiting effectiveness, is harmless, and is explosion-proof.

Without in any way limiting the scope of the present invention, it may be instructive to briefly discuss the mechanisms believed to be responsible for the efficacy of methods and systems according to the present invention. For illustrative purposes discussion is limited to a system including potassium chlorate, an epoxy resin and potassium chloride.

Upon combustion of an SFC made up of potassium chlorate (68 wt %), epoxy resin (16 wt %), and potassium chloride (16 wt %), without using magnesium, the following gaseous products, in the indicated mass fractions, were obtained:

| | |
|---|---|
| K | 0.026 |
| $H_2$ | 0.017 |
| $H_2O$ | 0.100 |
| HCl | 0.002 |
| $N_2$ | 0.160 |
| CO | 0.430 |
| $CO_2$ | 0.183 |
| KCl | 0.082 |

The condensed phase is made up of solid particles of $K_2CO_3$. The weight ratio of the gaseous phase to the condensed phase is 0.6 to 0.4.

During the cooling process of the aerosol in open air, KCl, KOH, $KHCO_3$, $K_2CO_3$ and perhaps oxides of potassium, such as KO and $K_2O$, pass from the gaseous phase to the condensed phase. The solid particles thus formed have a diameter on the order of approximately one micron.

When the aerosol interacts with the combustion zone of the fire which is to be extinguished, such as a hydrocarbon fire, both homogenous and heterogeneous reactions take place. The heterogeneous inhibition processes, usually between solid and gaseous phases, take place at temperatures of up to about 1000° K. Above this temperature the predominant inhibition processes are homogeneous, typically between gaseous reactants.

The heterogenous processes may be described with the aid of the following reactions:

$$A.+S \rightarrow AS \quad (1)$$

$$AS+A. \rightarrow A_2+S \quad (2)$$

where A. is a radical active species from the fire to be extinguished, S is the surface of a solid aerosol particle and $A_2$ is a molecular species.

From the above reactions it can be seen that the newly created AS can react with another active species to generate a stable molecular species while at the same time regenerating free aerosol particle surface which is available for further interaction with active species.

The homogenous inhibition processes taking place in the gaseous phase may be described by the following reactions:

$$K+.OH+M \rightarrow KOH+M \quad (3)$$

$$KOH+.H \rightarrow H_{20}+K \quad (4)$$

$$KOH+.OH \rightarrow H_{20}+KO \quad (5)$$

where .H and .OH are radical active species and M represents an energy input.

An SFC according to the present invention may be prepared in any convenient fashion. Three such methods will be described for illustrative purposes only without in any way limiting the scope of the present invention.

In one process, the various components are dry mixed together. The mixture is then mechanically pressed to form pellets or tablets of desirable size and shape.

In a second process, the various components are mixed together to form a paste. The paste is poured into an appropriately sized and shaped form or mold and is dried, for example by heating, to remove any solvent and harden the SFC.

In a third process the components are mixed together to form a paste. The paste is simultaneously dried and shaken on a screen to form a dry powder. The powder is placed into tubes or shells suitably shaped and sized to facilitate the functioning of the SFC.

Various improvements of the methods and systems according to the present invention are possible. Two such improvements involve the confining of the flames of the SFC when undergoing combustion and the cooling of the combustion products prior to their release to the fire to be extinguished.

When the SFC is ignited an open flame of the burning charge is created. Also, the aerosol formed on combustion of the SFC is at elevated temperatures. The presence of an open flame, may, in specific situations, such as, for instance, when the fire to be extinguished involves a hydrocarbon reservoir, have detrimental effects. Similarly, the high temperature of the aerosol militates against its uniform distribution in the volume being protected. The latter difficulty arises since a hot aerosol tends to first rise by natural convection toward the ceiling of the premises, reaching the focus of the fire to be extinguished only after the aerosol has cooled down sufficiently to descend onto the fire.

It is thus generally desirable to confine the flame produced in the combustion of the SFC while at the same time cooling the hot aerosol formed during the combustion of the SFC.

The confinement and cooling may be effected by any number of suitable methods. One such method is to allow the SFC to combust intensely with the subsequent combination, as by ejection, of the hot aerosol with a coolant. Another method involves the dispersal of the SFC through the intensive intermixing of the air medium with the aerosol formed in simultaneous combustion of the entire rated quantity of compounded mixture, the mass of which is distributed in the volume being protected.

In the first method of cooling, it is possible to use as a coolant air, nitrogen, carbon dioxide, water, aqueous solutions of sodium salts and potassium salts, and the like. Experiments have demonstrated that the application of water or aqueous solutions of salts is preferable, since these coolants have high heat capacities and heats of vaporization.

Two basic methods of carrying out the intermixing of gases and liquids are offered, by way of illustration. The first involves the displacement of the liquid into a mixing chamber with the gas flux. A second involves the ejection of the liquid by the gas flux into a mixing chamber where the pressures and temperatures of the two fluxes become uniform. The latter method offers a number of advantages over the first. Primarily, the method does not require a reservoir operating under pressure, and is of simpler design.

Procedures for designing gas-liquid ejectors are set forth in the monograph of E. Ya. Sokolov and N. M. Zinger "Fluidic Apparatus", Moscow, Gosenergoizdat Publishers, 1960 (in Russian), which is incorporated in its entirety by reference as if fully set forth herein. The gas-liquid ejector designs disclosed in the above-referenced monograph are largely inapplicable to the cooling of an SFC aerosol. This is because the flame or high-temperature aerosol is likely to break through into the mixing chamber and even into the volume being protected immediately after the ignition of the SFC cartridge due to a delay in the supply of the coolant flux.

To eliminate this disadvantage, and render methods and systems according to the present invention more practical, a device is proposed (referred to herein as "generator"), a basic embodiment of which is shown schematically in FIG. 1. The generator provides for the confined combustion of the compounded composition in the form of solid SFC cartridges, the obtaining of an active jet of the fire-extinguishing aerosol, and the cooling of the aerosol down to the required temperature through the ejection of a liquid coolant in the aerosol.

The generator includes a combustion chamber 10 in which SFC cartridges 12 are disposed. A working nozzle 14 serves to shape the aerosol flux. A receiving chamber 16 shapes the coolant flux. The flux enters a mixing chamber 18 where it undergoes cooling. An ignition device 20, such as an electric heater coil, serves to ignite SFC cartridges 12.

In contrast with known gas-liquid ejector devices, the generator according to the present invention serves to prevent the escape of the open flame or high-temperature aerosol from mixing chamber 18 into the volume being protected at the initial moment of burning of SFC cartridges 12.

A vessel 22 containing liquid coolant is disposed horizontally, and constitutes, in effect a housing for mixing chamber 18. Vessel 22 has a coolant opening 24 which enables the coolant in vessel 22 to communicate with receiving chamber 16. Coolant opening 24 ensures the ready approach of the free surface level of the coolant to the entrance portion of mixing chamber 18.

Ignition device 20 can be activated either automatically or manually. The activation of ignition device 20 may conveniently be tied to a sensor capable of detecting a high temperature in the volume to be protected indicating the presence of a fire.

When ignition device 20 includes an electric heater coil, the voltage supplied to activate the coil preferably ranges from about 12 V to about 20 V. The aerosol formed as a result of the burning of SFC cartridges 12 in combustion chamber 10 reaches working nozzle 14 where a high velocity hot aerosol stream is formed.

The raised aerosol stream velocity establishes a low pressure zone in receiving chamber 16 causing coolant to flow from vessel 22 into mixing chamber 18 through coolant opening 24. The approach of the free surface level of the coolant to the entrance portion of mixing chamber 18 effects the essentially simultaneous entrance of the coolant and the aerosol fluxes into mixing chamber 18. The rate of flow of the coolant into mixing chamber 18 can be regulated by the size of coolant opening 24 through which the coolant enters mixing chamber 18.

Vessel 22 containing the coolant features a vessel opening 26 for communication with the atmosphere for the purpose of equalizing the pressure in the coolant vessel during operation thus preventing the formation of a vacuum in the vessel. Vessel opening 26 is preferably provided with a check valve for reducing losses of the coolant which can come about through the evaporation of coolant during the operation of the fire-extinguishing system. The above-described method allows the aerosol to be cooled down to a temperature not exceeding 100° C. while preserving the small particle size of the solid aerosol particle and thereby preserving the excellent fire extinguishing capacity of the aerosol.

Figure 4:
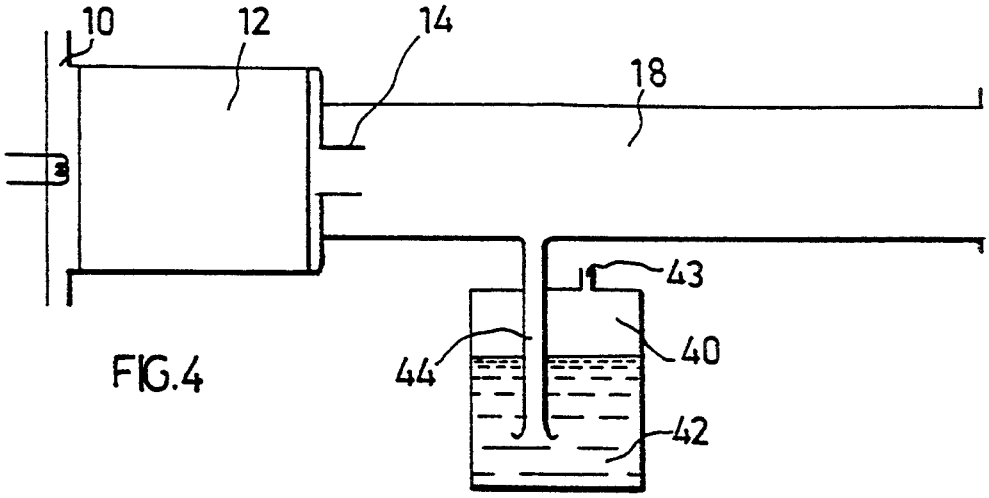
FIG. 4 is yet another alternative configuration including the secondary introduction of powder and including a secondary combustion chamber.

Two variations of the above-described cooling method are depicted schematically in FIGS. 3 and 4. In FIG. 3 is shown a system which uses air rather than a liquid as the coolant. Although air has a lower heat capacity than water and is thus not as effective a coolant as water, the configuration shown in FIG. 3 has the advantage in that the aerosol does not become wet during cooling which could reduce its fire extinguishing capabilities.

The device in FIG. 3 functions is roughly the same way as that of FIG. 1. The device features a combustion chamber 10 containing SFC cartridges 12. The formed aerosol exits combustion chamber 10 through a working nozzle 14 and enters mixing chamber 18. Mixing chamber 18 features orifices 30 which allow air from the surrounding atmosphere to be sucked into mixing chamber 18 following ignition of the SFC and the formation with the aid of nozzle 14 of a high velocity aerosol stream in mixing chamber 18.

In FIG. 4 is shown a system which adds powder of suitable composition to the newly formed aerosol and then allows the aerosol/powder mixture to undergo secondary combustion. Use of this staged combustion serves to accommodate an increased charge of extinguishing material and gives the discharged aerosol jet a larger firing range.

The configuration of FIG. 4 is similar to that shown in FIG. 1 but with the addition of a powder container 40 which contains a charge of powder 42 and features an air hole 43. The powder can be any suitable powder including, but not limited to, standard fire extinguishing powders, such as those based on ammonium phosphate, and having particles on the order of 50 microns. The configuration of FIG. 4 results not only in the cooling of the aerosol but also can be used to enhance the local fire extinguishing capabilities of the apparatus of type A fires.

In operation, the high velocity stream in mixing chamber 18 draws powder 42 from powder container 40 through a tuyere 44. Powder 42 is mixed with the aerosol in mixing chamber 18 thereby cooling it and producing an aerosol with a modified particle size and composition which is more optimal than the original aerosol for fighting certain fires.

A second basic method of cooling the aerosol involves the intensive intermixing and dispersal of the SFC material in the volume being protected (FIG. 2). An amount of SFC calculated to be sufficient for extinguishing the anticipated fire, is placed in the form of a powder 50 into a combustible or otherwise destructible casing 52. Casing 52 may, for instance be made of polyethylene films or tubes, and the like. The SFC may alternatively be arranged, if desired, in a non-combustible box (not shown) having one or more slots for accurately directing the aerosol jet to the focus of fire.

Casing 52 features, at or near its centerline, an ignition device, such as an incandescent filament 54, located so as to be capable of simultaneously igniting the entire composition when voltage is applied to filament 54. The required amount of the SFC may be distributed in shells of a convenient length, and a number of shells may be interconnected either serially or in parallel, depending on the circumstances.

The diameter of casings 52 should preferably not exceed about 30 mm. When deployed, the modules should preferably be arranged along the periphery of the object being protected against fire or of the locations where combustible substances and materials are concentrated, to maximize the fire extinguishing effectiveness of the system.

Electrical filament 54 can be ignited either automatically and manually. The activation of filament 54 effects the simultaneous ignition of the entire SFC, brings about the destruction of casing 52, and makes possible the intensive intermixing of the resulting aerosol with the surrounding air. The combustion of such modules, once ignited, lasts approximately two seconds. The result is a rapid intermixing of the aerosol with air, leading to the cooling of the aerosol. This is in contrast with the first cooling method described above wherein the action of the generator leads to the formation of a compact flux of the aerosol.

In other alternative embodiments of methods and systems according to the present invention, cooling is accomplished by allowing the aerosol to pass through a liquid coolant, such as water. Examples of three systems illustrative of such methods are depicted schematically in FIGS. 5, 6 and 7.

The embodiments depicted in FIGS. 5 and 6 are most suitable for operation in the protection against fire of vessels containing flammable liquids, such as hydrocarbons. A typical vessel 50 is depicted in FIGS. 5 and 6. Vessel 50 contains a liquid oil product 52 and a vapor space 54 located above liquid oil product 52. Near the top of vessel 50 is an air orifice 56 for equalizing the pressure in air space 54. Disposed near the bottom of vessel 50 are one or more generators 58, preferably located on the outside of vessel 50 and capable of injecting aerosol into vessel 50 near its bottom portion. Generators 58 can be activated though a power source 60 connected to generators 58 via electrical wires 62.

When a fire is detected in vapor space 54 generators 58 are activated, sending hot aerosol into the lower portion of vessel 50. The aerosol forms bubbles 64 in the liquid oil product, which rise through the liquid oil product. During its rise, the aerosol is cooled through contact with the surrounding liquid oil product. By the time the aerosol reaches vapor space 54, the aerosol is sufficiently cooled to effectively carry out its fire extinguishing function in vapor space 54.

Figure 6B:
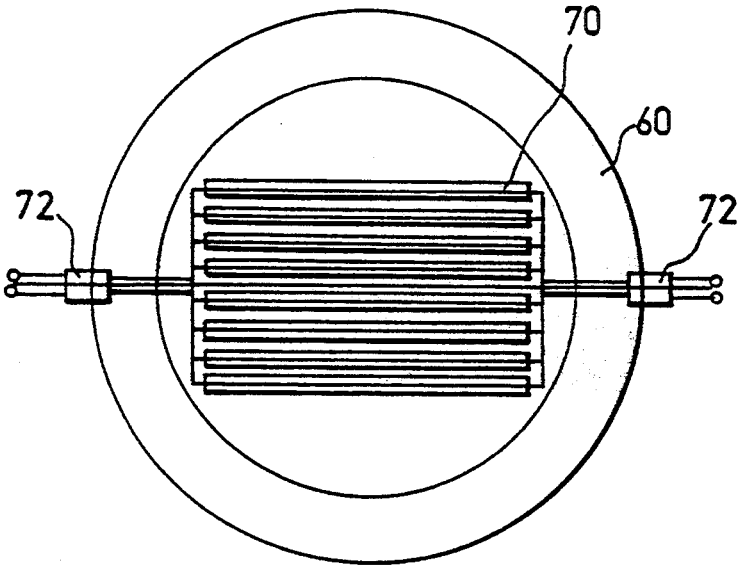

A variation of the above-described embodiment is depicted in FIGS. 6*a* and 6*b* which show a system similar to that shown in FIG. 5 except that rather than using generators featuring SFC cartridges, powdered SFC is stored in destructible casings 70 near the bottom of vessel 50. When a fire is detected, ignition sources 72 are activated, which, in turn, activates the SFC powder, causing a hot aerosol to be produced. The aerosol is cooled on its way up as in the embodiment of FIG. 5.

A variation of the embodiment shown in FIGS. 5 and 6 is shown in FIGS. 7*a* and 7*b*. FIG. 7*a* shows an individual fire extinguishing module 100. Module 100 includes a container 102 which is at least partially filled with a coolant, preferably water 104. Immersed in water 104 is a quantity of SFC 106 which is enclosed by a destructible membrane 108 which, when intact, is impermeable to water. Module 100 also includes ignition device 20 similar to those described above. Ignition device 20 may be connected to the power source (not shown) by electrical wire 62.

A unit such that shown in FIG. 7*a* works the same way as those shown in FIGS. 5 and 6, except that the liquid through which the aerosol is made to pass in the embodiment of FIG. 7 is not the liquid normally found in the volume to be protected but is rather a liquid provided in the module expressly for the purpose of cooling the aerosol. In operation, the unit of FIG. 7*a* is placed in the volume to be protected.

When ignition device is activated, the SFC reacts, forming gases which bubble through the dedicated coolant and which, therefore, enter the volume to be protected properly cooled. To prevent the evaporation of the coolant, typically water, during the usually long periods between the implementation of the module and its use, it may be beneficial to place a thin layer of non-volatile lower density liquid on top of the water to cut down on the rate of evaporation of the water.

In practice, modules such as those of FIG. 7*a* will typically be used as part of a system which includes a number of such interconnected units. An example of this is shown in FIG. 7*b* where a number of modules 100 are connected electrically to form a network which can be activated when appropriate to provide fire protection in a protected volume 110.

The effectiveness of methods and systems according to the present invention can be further appreciated with reference to the following examples.

EXAMPLE 1

Three sources of fire were disposed in premises having the volume of 11.6 $m^3$. One was a pan of 0.2 $m^2$ in area containing 10 liters of kerosine. A second was a pile of firewood weighing 5 kg. The third was a pile of 1.5 kg of rags wetted with kerosine.

The premises were airtight except for an opening which constituted approximately 8% of the surrounding enclosing structure. An SFC cartridge, 10 cm in diameter and 7.5 cm high, weighing 0.9 kg was disposed inside the premises. The SFC was made up of potassium chlorate (45 wt %), epoxy resin (16 wt %), potassium chloride (35 wt %) and magnesium (4 wt %). The sources of fire were ignited with the help of a torch. Free flaming-up time was 15 min. The burning process was monitored by means of thermocouple and a potentiometer, as well as visually through an inspection port.

The SFC cartridge was ignited remotely by supplying electric power to a Nichrome heater coil from a voltage regulator. Burning time of the SFC cartridge was 85 seconds. In the course of the experiment the products of combustion of the sources of fire and of the aerosol were observed to escape from the premises through the openings.

Extinguishing of the sources of fire was registered by the thermocouple to occur in 70 seconds. The premises were opened two minutes later. Weak residual smoldering was found in the focus with the rags. It is believed that a longer application of the aerosol would have arrested this smoldering as well.

The results of the test demonstrate that the extinguishing capacity of the SFC is high ($\approx$0.08 kg/$m^3$) and that use of SFC for extinguishing fires of Classes A and B in closed volumes is unproblematical.

It should be noted that the activation of the SFC and the dispensing of the aerosol were purposefully delayed. Under normal conditions, the SFC would be activated much sooner and would achieve more optimal fire extinguishing results. In such cases of more optimal dispensing onset times, the extinguishing concentration is expected to be still lower than that found in the present experiment.

EXAMPLE 2

The sources of fire contained gasoline of grade A-76 in premises having the volume of 26 $m^3$ with a window with an open area of 0.9 $m^2$. Gasoline was poured into small pans disposed on different levels within the premises. The premises were equipped with thermocouples for registering the moment of time when the fires were extinguished. For purposes of comparison, three separate extinguishing means were used sequentially—SFC, a diammonium phosphate powder, and Halon 1301. The SFC used in these experiments were tablets varying in size from 0.5 to 1.0 kg, for a total weight of 2.1 kg. In each case the SFC was made up of 20 wt % $K_2Cr_2O_7$, and 80 wt % gunpowder "H". The results are shown in Table 1.

TABLE 1

| | Extinguishing Means | | |
|---|---|---|---|
| | SFC | Diammonium Phosphate | Halon 1301 |
| Concentration at which extinction is attained, (kg/$m^3$) | 0.08 | 0.2 | 0.4 |

As is seen from this table, the SFC composition ensures volume extinguishing of gasoline in premises with leakiness of about 2% at concentrations which are considerably lower than the extinguishing concentrations of diammonium phosphate powder and Halon 1301.

EXAMPLE 3

A fire of a gas condensate, which is a mixture of hydrocarbons with flash point of −40° C. in a reservoir 3 m in diameter and 1.5 m in height, made of 4 mm thick steel, was extinguished by means of SFC dispensed by a pair of generators whose design was describe above. The roof of the reservoir was equipped with a rectangular hatch 0.4×1.5 m in size, provided with a shutter for varying the size of the opening.

Water was poured into the reservoir. Sufficient condensate was then poured on top of the water to form a 20 mm layer of condensate. The free volume of the reservoir was 3 $m^3$. Extinguishing was carried out with the help of two generators, each containing three SFC cartridges, 5 cm in diameter and 3 cm high, weighing 0.09 kg each. The SFC was made up of potassium chlorate (46 wt %), potassium chloride (44 wt %) and epoxy resin (10 wt %). The coolant used was water.

The condensate was ignited by means of a torch. The SFC cartridges were ignited by means of Nichrome heater coils, powered by an electric current having a voltage of 20 V supplied by a voltage regulator.

In the first test the time of free burning of the condensate was 30 s. The area of the opening in the hatch of the reservoir roof was adjusted to 0.6 $m^2$, which is 10% of the total roof area. This is to be compared with the overall area of the openings in actual typical reservoirs having volumes of 5000 $m^3$, which are on the order of 1.5%. After the electric heater coils were activated, ignition of the cartridges in both generators were ignited. The operating time of the generators was 30 seconds. Extinguishing was accomplished 20 seconds after the ignition of the SFC cartridges. No re-ignition of the condensate was observed.

Ten minutes later the condensate was ignited again by means of a torch and was allowed to completely burn out. The burning lasted 20 minutes.

In the second test the time of free burning of the condensate was 200 seconds. The hatch in the roof of the reservoir was fully open. The extinguishing time was 25 seconds after activating the generators. Just as was observed to the case in the first test, no re-ignition of the condensate took place. In both experiments the aerosol concentration of SFC was 0.18 kg/m$^3$.

It was concluded that the first method provides successful extinguishing of fires in reservoirs with gas condensate which are normally difficult to extinguish. Experience with actual fires in reservoirs containing condensate have shown that it is not normally possible to extinguish such fires using conventional means.

EXAMPLE 4

Inhibition of hydrogen/air and methane/air stoichiometric mixtures was performed in a standard installation for determining the concentration limits of flame propagation. The desired mixtures were prepared in an evacuated glass vessel, 0.06 m in diameter and 1.5 m high, by monitoring the partial pressures of the components. The SFC was made up of potassium chlorate (46 wt %), potassium chloride (44 wt %) and epoxy resin (10 wt %). Ignition was effected by a spark from a high-voltage induction coil at the bottom end of the tube. The results of the experiments are shown in Table 2.

TABLE 2

| Combustible (explosion-hazardous) mixture | Inhibition Concentration, kg/m3 | | |
|---|---|---|---|
| | SFC | Monex powder | Halon 1301 |
| Hydrogen - air (10% H2, 90% air) | 0.07 | 0.28 | 9.97 |
| Hydrogen - air (20% H2, 80% air) | 0.223 | 0.77 | 1.38 |
| Methane - air (10% CH4, 90% air) | 0.08 | 0.25 | 0.22 |

From the tabulated data it is apparent that with the help of an SFC composition one can successfully achieve inhibition in the case of highly combustible gases leaking into the premises. With the help of SFC it is possible to inhibit even hydrogen/air mixtures, which are nearly impossible to inhibit with Halon or with the most effective fire-extinguishing powders.

EXAMPLE 5

The persistence of the aerosol extinguishing capacity of the aerosol was checked in a chamber 0.6 m in diameter and 2.45 m high, made of a transparent material. The chamber featured a series of vertically spaced apertures through which sources of fire, in the form of a torch, could be introduced, and through which sampling of the interior of the chamber could be effected. The aerosol was introduced into the chamber from below with the help of a generator with a coolant. The maximum temperature of the aerosol at the chamber entrance was 100° C. The SFC was made up of potassium chlorate (46 wt %), potassium chloride (44 wt %) and epoxy resin (10 wt %).

The experiment demonstrated that the extinguishing effect of the aerosol in the entire volume of the chamber persisted for 30 min. Complete extinguishing of the torch in the upper part of the chamber was not attained at the end of 30 minutes, but was attained in the lower-lying sections of the chamber. The loss of the extinguishing capacity throughout the chamber volume was observed after 42 minutes.

Extinguishing aerosols formed according to the present invention are characterized in that they are made up of very fine particles, typically under 1 micrometer. The advantage in terms of a large surface area to volume ratio has been discussed and demonstrated. An additional advantage of systems according to the present invention is that the extremely fine particles are able to float and be suspended in air thus retaining their effectiveness for long periods of time.

Even the finest conventional dry powders are unable to stay suspended for long periods of time. The conventional powders are thus unable to readily mix with the air and effectively extinguish the fire in the protected volume. Once released into the protected volume, a large fraction of the particles in these powders tends to rapidly settle, thereby greatly reducing the fraction of the powder which is able to effectively take part in the extinguishing process.

By contrast, the particles produced by systems according to the present invention, because of their very small size, tend to remain suspended in the air, or float, for long periods of time which tend to increase at higher temperatures.

An SFC mixture according to the present invention can take the form of a powder or it can be in the form of a solid cartridge, such as a solid tablet, pill or pellet. In addition, the SFC can also be in the form of a paste or jelly. In any of these forms, the SFC can be shaped so as to maximize its fire extinguishing effectiveness. Such shaped cartridges, powders or jellies make it possible to direct the release of the aerosol in the desired directions and at the desired rates.

Along these lines, it is also possible to vary the density of the cartridge, powder or jelly so as to further optimize the functioning of the SFC material.

While the SFC material is preferably pre-positioned in the volume to be protected, it may also be stored in the vicinity of the volume to be protected and deployed into the protected volume only when conditions, such as a fire, call for such a deployment.

Another example of the deployment of SFC material according to the present invention involves the suspending of the material above the location where the fire is expected using a fusible link, such as a meltable wire. When conditions are such that it is desirable to deploy the SFC, the fusible link is severed, allowing the SFC to drop onto the fire and extinguish it. The fusible link may be severed directly, as by melting in the face of an increased temperature. Alternatively, the link may be severed indirectly, as by a mechanical device activated in response to a detection of fire conditions in the protected volume.

Activation of SFC can be by any convenient means, such as those described in the main application. One of these is self-ignition in response to heating caused by the fire to be extinguished. For example, the SFC material could be so designed that it will spontaneously combust at temperatures above 350° C.

Various materials could be used as coolants. It may be highly desirable to use a combination of nitrogen and carbon dioxide which, apart from being capable of efficiently cooling the aerosol, are also highly efficient in extinguishing the fire.

While the invention has been described with respect to a number of preferred embodiments, it will be appreciated that many variations, modifications and other applications of the invention may be made.

What is claimed is:

1. A method of extinguishing a fire in a volume, comprising:

(a) pre-positioning a fire extinguishing medium in communication with the volume, said medium including a composition which includes:

(1) a first reactant which includes one or both of potassium perchlorate and potassium nitrate; and (2) a second reactant which includes epoxy resin;

(b) activating said medium in situ so as to cause said first reactant and said second reactant to react with each other to create a non-toxic aerosol of dry powder having solid particulate products having a diameter of about one micron or less, said aerosol being such that when said aerosol comes in contact with the fire, said products chemically and physically inhibit the chain reactions of the fire flame and bring about the extinguishing of the fire;

(c) cooling said aerosol through contact of said aerosol with a cooling medium; and (d) arresting flames which may accompany the aerosol.

2. A method as in claim 1, wherein said medium includes from about 40 to about 70 wt % potassium perchlorate, from about 9 to about 25 wt % epoxy resin, from about 15 to about 44% wt % potassium chloride and up to about 4 wt % magnesium powder.

3. A method as in claim 1, wherein said medium includes from about 65 to about 70 wt % potassium perchlorate, from about 12 to about 18 wt % epoxy resin and from about 16 to about 20% wt % potassium chloride.

4. A method as in claim 1, wherein said medium includes from about 37 to about 45 wt % potassium perchlorate, from about 16 to about 19 wt % epoxy resin, from about 37 to about 45% wt % potassium nitrate and from about 1 to about 3 wt % magnesium or aluminum powder.

5. A method as in claim 1, wherein said medium includes from about 70 to about 80 wt % potassium nitrate, from about 19 to about 23 wt % epoxy resin and from about 2 to about 4 wt % magnesium or aluminum powder.

6. A method as in claim 1, wherein said cooling medium is selected from the group consisting of dry extinguishing powder, water, eutectic salts, ethylene glycol and carbon dioxide.

7. A method as in claim 1, further comprising detecting a fire condition, said detection serving to activate the in situ reaction of said first and second reactants.

8. A method as in claim 1, wherein said composition further includes at least one fire extinguishing dry powder selected from the group consisting of potassium chloride, ammonium phosphate, sodium sulfate, sodium bicarbonate and sodium carbonate.

9. A method as in claim 1, wherein said activation is effected by the fire.

* * * * *